US009468839B1

(12) United States Patent
Bryan

(10) Patent No.: US 9,468,839 B1
(45) Date of Patent: Oct. 18, 2016

(54) GAME SYSTEM INTEGRATING ELECTRONICS WITH A GAME BOARD AND GAME HAVING A TOURING BAND THEME

(76) Inventor: Paul J. Bryan, Raleigh, NC (US)

( * ) Notice: Subject to any disclaimer, the term of this patent is extended or adjusted under 35 U.S.C. 154(b) by 712 days.

(21) Appl. No.: 12/507,918

(22) Filed: Jul. 23, 2009

(51) Int. Cl.
*A63F 3/00* (2006.01)

(52) U.S. Cl.
CPC ..... *A63F 3/00063* (2013.01)

(58) Field of Classification Search
CPC ..... A63F 3/00; A63F 3/00119; A63F 2003/00123; A63F 2003/00018; A63F 2003/00009
USPC ..... 273/242, 243, 249, 244.2
See application file for complete search history.

(56) References Cited

U.S. PATENT DOCUMENTS

| | | | | |
|---|---|---|---|---|
| 4,049,276 | A * | 9/1977 | Hole | 273/252 |
| 4,426,084 | A * | 1/1984 | Michel | 273/254 |
| 4,998,736 | A * | 3/1991 | Elrod | 273/249 |
| 6,279,908 | B1 | 8/2001 | Hunsberger | |
| 2002/0190466 | A1 * | 12/2002 | Bryan | 273/254 |
| 2006/0097449 | A1 * | 5/2006 | Gagnon | 273/242 |

* cited by examiner

*Primary Examiner* — Vishu Mendiratta
(74) *Attorney, Agent, or Firm* — Coats and Bennett PLLC

(57) ABSTRACT

A game board and game apparatus is provided with the game board including a network of paths that originate at a starting point and which lead to a performing stage. The network of paths is specifically designed to be a tool utilized functionally by the players in conjunction with the other structural elements of the invention to stop opposing players from achieving the object of the game, thus affecting the length of the game. The overall theme of the game revolves around a touring band and the object of the game is to arrive on the performing stage with a certain number of band members and with band equipment. Forming a part of the game is a series of tokens that are moved along the network of paths. Further, there is provided a deck of "Consequence" cards with three different configurations within the deck of cards designed to enable the players to control the length of each game played, a printer/computer preprogrammed with the structure of the deck of "Consequence" cards containing the three different configurations designed to enable the players to control the length of each game played, a deck of "Band Member" cards, and a set or deck of "Band Equipment" cards. During the course of the game, as the tokens are advanced along the network of paths, the individuals playing the game will deal with consequences expressed by the "Consequence" cards due to landing on certain increments of the network of paths and further the players will aim to collect a certain number of band cards that represent a single band and at the same time collect at least one "Band Equipment" card, all prior to reaching the performing stage.

17 Claims, 7 Drawing Sheets

1. PAY CHECK - $2,000.00
2. CAMPGROUND - TRADE 2 CARDS LEFT
3. TWIST OF FATE
4. PAY CHECK - $800.00
5. BUS STOP - DRAW 1 CARD
6. MUGGED - PAY $1,000.00
7. BAND MEMBER OD'S - DISCARD 1 CARD, LOSE NEXT TURN
8. BAND SPLITS UP - DISCARD 3 CARDS
9. ONLINE TRADING PAYS OFF - ROLL X $1,000.00
10. FLASH BACK - ROLL AGAIN MOVE BACKWARD
11. TWIST OF FATE
12. BUS STOP - DRAW 1 CARD
13. PAY RENT - $800.00
14. ROLL 1 DIE, EVEN DRAWS, ODD DISCARDS (ROLL 2ND DIE) NUMBER OF CARDS
15. DEJA VU - BACK TO PARKING LOT
16. BUSTED - ROLL PAY X $200.00, LOSE NEXT TURN
17. PLAY NIGHTCLUB - COLLECT $1,000.00, DRAW 2 CARDS
18. TWIST OF FATE
19. PAY TAXES - $2,000.00
20. BUY BAND EQUIPMENT - PASSING BY $20,000.00, LAND ON $10,000.00
21. FEED YOUR HEAD - PAY $500.00
22. BIG PAY CHECK - $1,000.00 PER CARD IN YOUR HAND
23. BUS STOP - DISCARD 1 CARD
24. TWIST OF FATE
25. PAY RENT - $800.00
26. HOUSE PARTY - DRAW 3 CARDS
27. TWIST OF FATE
28. PAY CHECK - $800.00

*FIG. 1A*

(29) SPEEDING TICKET - ROLL X $100.00
(30) BUS STOP - DRAW 1 CARD
(31) TWIST OF FATE
(32) BUS WRECK - PAY $25,000.00, LOSE NEXT TURN
(33) WIN LOTTO - COLLECT $50,000.00
(34) PAY CHECK - $700.00
(35) TWIST OF FATE
(36) PLAY FESTIVAL - COLLECT $5,000.00, DRAW 2 CARDS
(37) BAND EQUIPMENT STOLEN - DISCARD BAND EQUIPMENT CARD
(38) TWIST OF FATE
(39) PAY RENT - $800.00
(40) PAY CHECK - $1,000.00
(41) TWIST OF FATE
(42) PAY RENT - $1,000.00
(43) TWIST OF FATE
(44) PAY CHECK - $800.00
(45) BUS STOP - DISCARD 1 CARD
(46) TWIST OF FATE
(47) RELEASE NEW CD - ROLL COLLECT X $2,000.00
(48) BUS STOP - DRAW 2 CARDS
(49) PAY RENT - $800.00
(50) TWIST OF FATE
(51) PLAY AMATEUR NIGHT AT CORNER BAR - DRAW 2 CARDS
(52) TWIST OF FATE
(53) BUS STOP - DRAW 1 CARD
(54) BUS STOP - DISCARD 1 CARD
(55) TWIST OF FATE
(56) PAY CHECK - $800.00
(57) - (65) TWIST OF FATE

*FIG. 1B*

GAME SYSTEM INTEGRATING ELECTRONICS WITH A GAME BOARD AND GAME HAVING A TOURING BAND THEME

FIELD OF THE INVENTION

The present invention relates to a gaming system, and more particularly to a game which integrates a game board and game with electronics to create a gaming system enabling players to control the length of each game played that carries a theme of a touring band. The present invention also enables the players to easily personalize and customize the game, using popular technologies.

BACKGROUND OF THE INVENTION

Game boards and games played on game boards have long provided much enjoyment and pleasure for people of all ages. However, in recent years game boards and games played on game boards seem to have been replaced by computer games and games played on or with electronic devices. These game boards and games that have been enjoyed in the past have been of various types and have carried many different themes and in the end have involved many objectives. It may be difficult to precisely identify what makes one game board and game more successful than another. However, we do understand and appreciate that game boards and games that have the ability to focus the attention of individuals over a significant time period, say for example, an hour or more, do generally enjoy significant commercial success. In their own way, these game boards and games sometimes border on addiction as individuals are able to have fun and enjoyment playing the games for hours at a time. In terms of what contributes to the attractiveness of a game board and a game played on the game board, this may vary from game to game, but in most cases it is probably a combination of a number of factors. Certainly game boards and games that require skill in order to be efficient in playing the game have appeal. But equally appealing is a game board and game that tends to intermix skill and luck in such a fashion that one player is not able to dominate the game based on skill alone and that various combinations of skill and luck combined can over the long run provide for exciting, challenging and competitive games.

There is always a need for game boards and games that somehow present a game that rewards various combinations of skill and luck and at the same time evokes subjects of interest to a wide sector of our society.

SUMMARY OF THE INVENTION

The present invention integrates the nostalgia of a game board and game with popular types of modern day technology. A printer is provided which is preprogrammed with a structure of multiple configurations of consequences, where each configuration is utilized on an individual basis with other structural elements of the invention to enable the players to control the length of each game played. The structure of each configuration of the deck of consequence cards is designed to have a specific effect on the length of each game played when utilized in conjunction with the other structural elements of the invention. The interaction between the specific designs of the structural elements of the invention enables the players to control the length of each game played. Each consequence card is identified with a song title and the corresponding consequence relates to the song title. For example, card number 41 contains the song title "Wish You Were Here" and the corresponding consequence reads "Every player moves to the same space you are on no one draws a twist of fate card and you roll again". Another example is card number 13, the title reads "Goodtimes Badtimes" and the consequence is "Draw 3 cards and pay $2000.00", something good and something bad. The printer has a port where the players can connect their personal computer, MP3 players, or iPod and download their favorite songs into the printer's processor. The players are then able to substitute their own favorite song titles for the song titles of the preprogrammed consequence cards, and printout a personalized deck of consequence cards using one of the multiple configurations. The printer is equipped with a keypad and speakers. The players can use the keypad to manually input their own consequences to further personalize and customize the game, and the speakers will play the songs of the song titles printed on each consequence card. A game board is provided that includes a performing stage and a starting point. Between the performing stage and the starting point there is provided a network of paths that leads from the starting point to the performing stage. The design of the game board and specific indicia on the game board imparts functionality to the different segments on the pathways. For example, at each fork in the network of paths consequence spaces are staggered at different increments which enable the players to utilize the pathways functionally in conjunction with the consequence cards and the structure of the deck of "Band Member" cards to play "Offense" or "Defense" and also enables the players to utilize the pathways functionally to stop opposing players from achieving the object of the game creating a "Mob Like" atmosphere where the players will instinctively gang up on any player which seems to be winning at any given moment. The Players utilize the structure of the three different configurations of the consequence cards, in conjunction with their ability to utilize the pathways functionally in order to control the length of each game played. Tokens are provided with the game and through the roll of dice the tokens are advanced incrementally along various paths that constitute the network of paths, with the object always being to ultimately advance the tokens to the performing stage. In the course of moving from the starting point to the performing stage, each player will encounter consequences along the way and these consequences are tied to various increments denoted on the various paths. Additionally, in a preferred embodiment of this invention, the object is for a player to arrive at or on the performing stage with a select group of band members and band equipment. Therefore, to achieve this in the context of the present game, there is provided a deck of "Band Member" cards and a deck or set of "Band Equipment" cards. As each player moves from the starting point along individual paths of the network, the player will have opportunities to receive "Band Member" cards from the band member card deck and exchange "Band Member" cards among the various players. In the end, it is the object of the game for a player to reach the performing stage with a certain number of "Band Member" cards wherein the "Band Member" cards are of a single group that represents a band. Further, along the way, as the individual players move towards the performance stage, they will be required to purchase a "Band Equipment" card that will be representative of the band equipment that will be used by the band upon arriving at the performance stage.

Other objects and advantages of the present invention will become apparent and obvious from a study of the following description and the accompanying drawings which are merely illustrative of such invention.

BRIEF DESCRIPTION OF THE INVENTION

FIGS. 1A and 1B are key descriptions of various actions or consequences that are a result of a token landing on the various keyed increments of the paths found on the game board.

Figure 3:
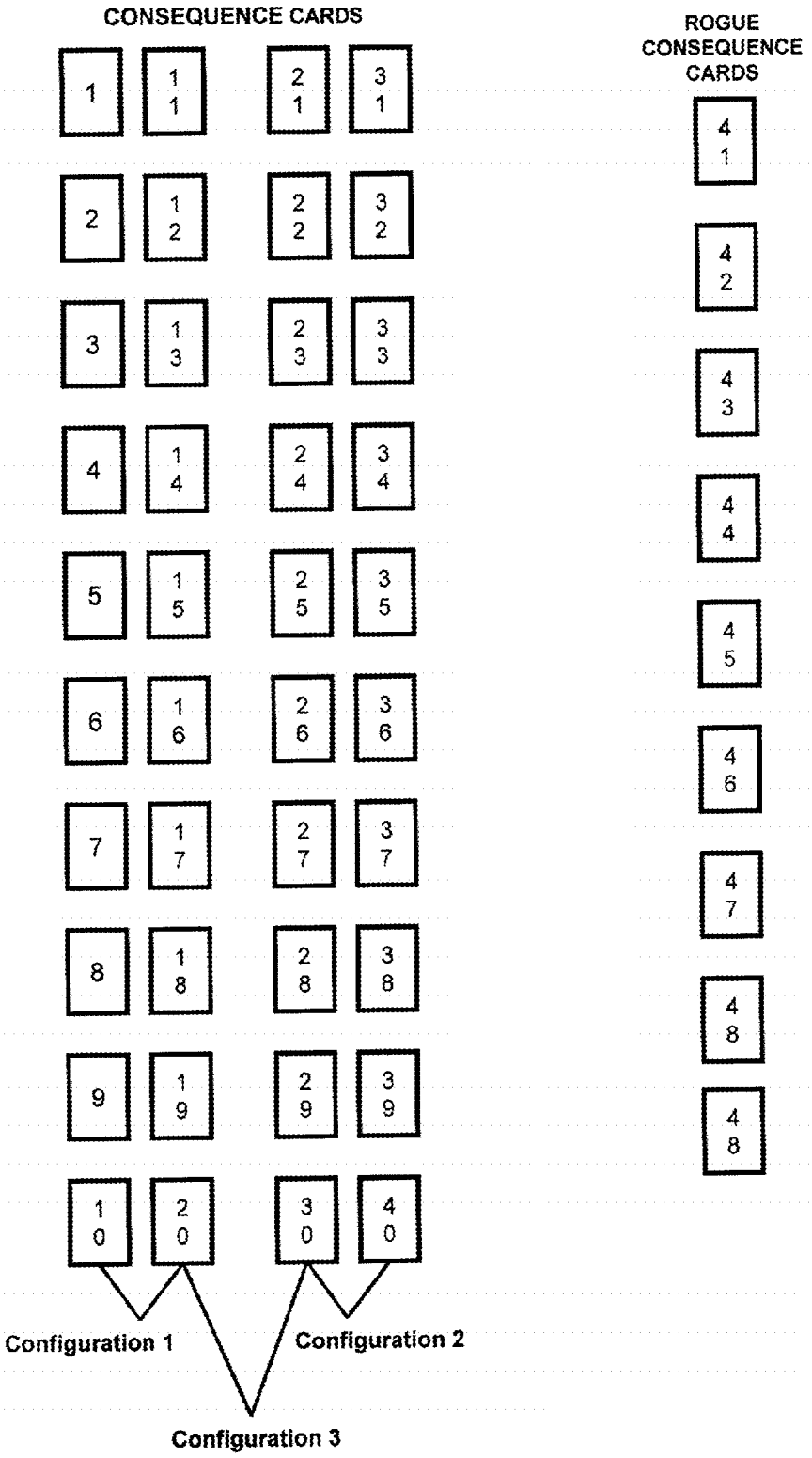

FIG. 3 is the structure of the three different configurations "#1, #2, and #3" of the "Consequence" deck of cards, and a set of "Rogue Consequence" cards. Each number on each of the "Consequence" cards represented in FIG. 3, corresponds to the numbers of the "Consequence" cards as stated in FIGS. 1A and 1B. Configurations "#1, #2, and #3" are constructed with specific groupings of consequence which are utilized by the players to control the length of each game played. The set of "Rogue consequence" cards are optional and each "Rogue" card is used on an individual basis by the players to further personalize and customize the game, and will affect the length of each game played in an undetermined way.

Figure 4:
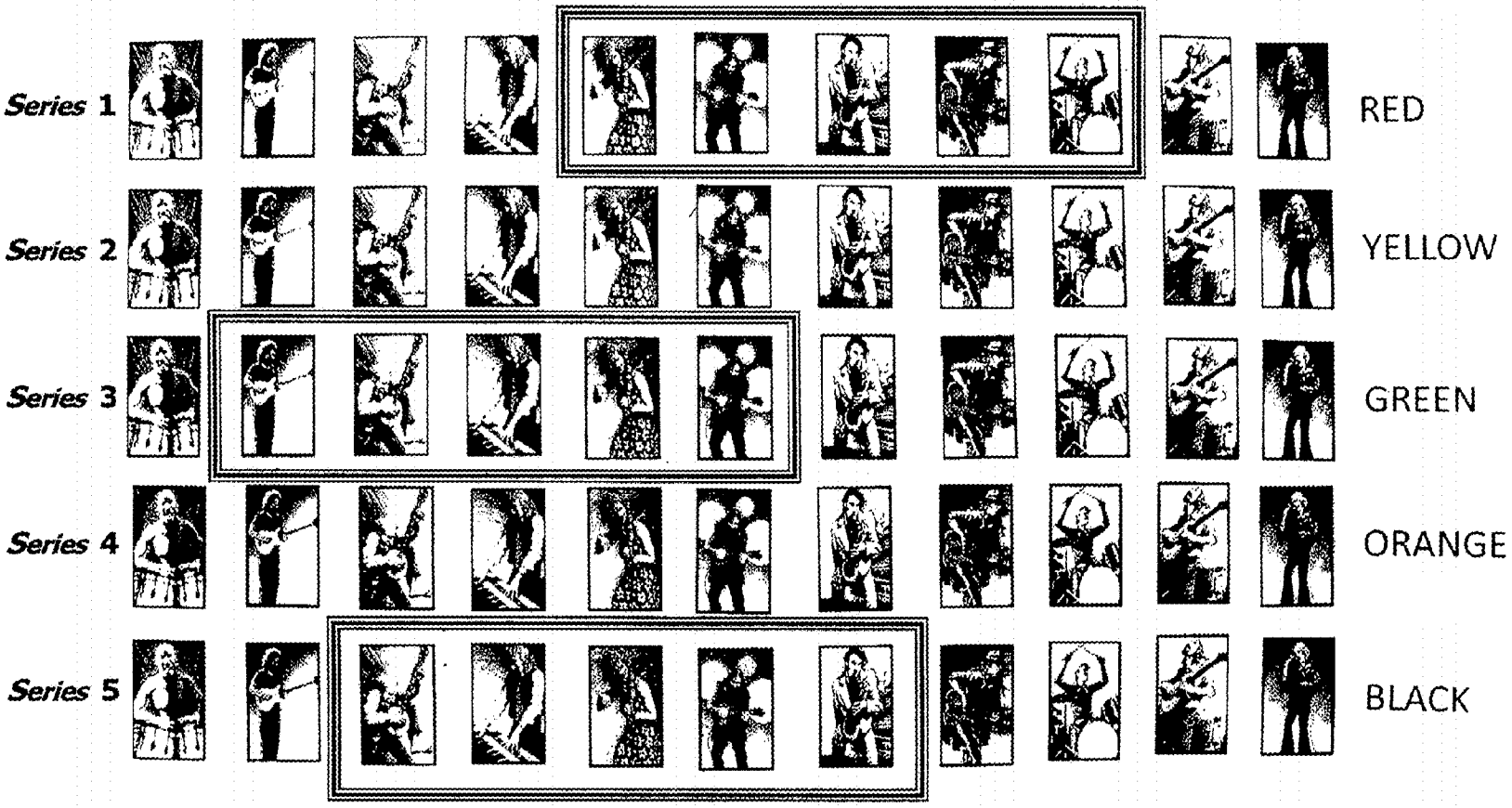

FIG. 4 is the structure of the plurality of predetermined groups of collectable "Band Member" cards where the collective substrates support and present the printed matter as a functioning structure. The functioning structure of FIG. 4, is interrelated in a functional way with both the structure of the groupings of the different configurations of FIG. 3, and the functional design of the game board and strategic placement of the consequence spaces on the pathways in relation to the forks in the pathways of FIG. 1.

Figure 5:
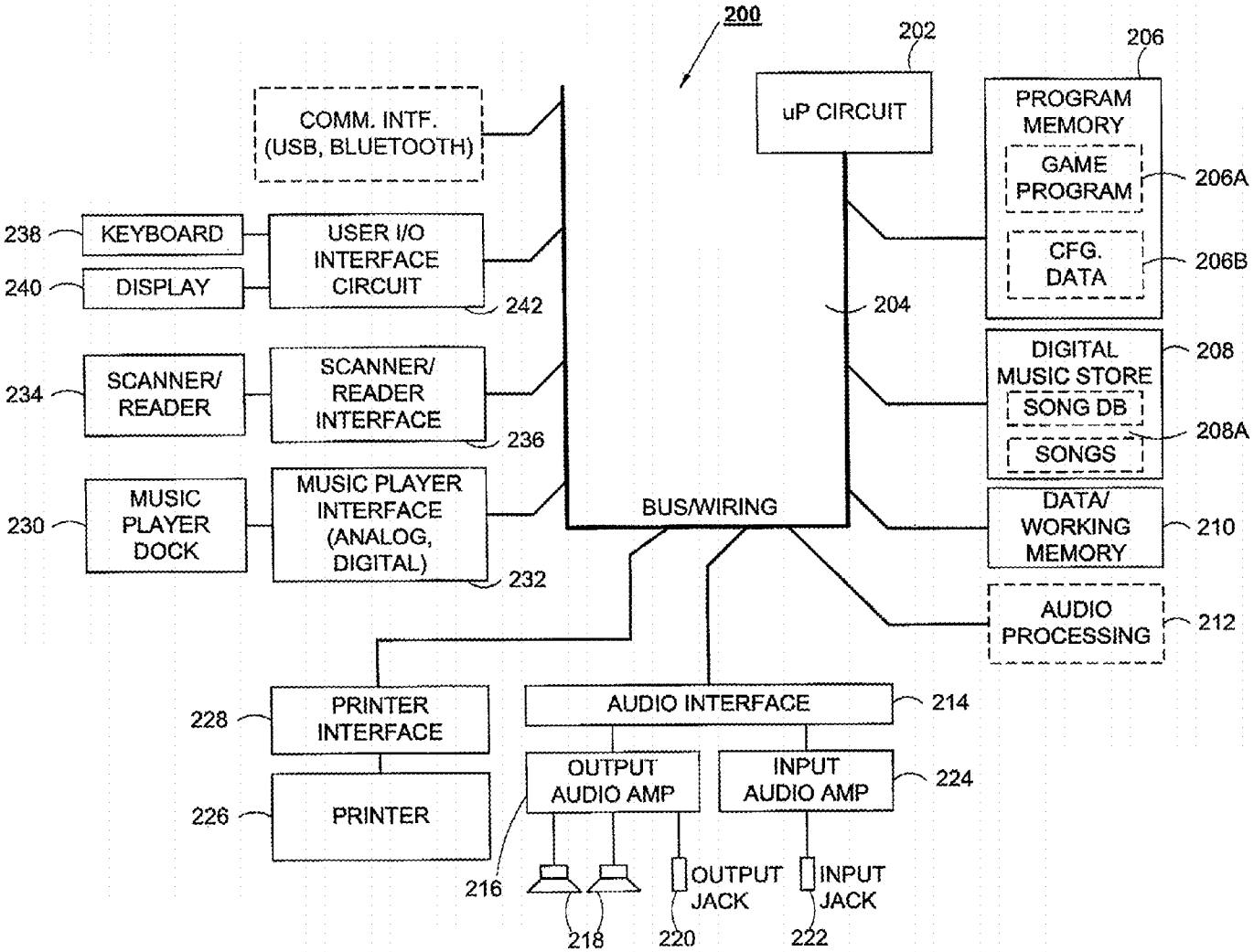

FIG. 5 is the schematic of the design of the printer. The printer is equipped with speakers, a port, a processor with the ability to download songs and to assign bar-codes to each song title printed on each "Consequence" card, with a keypad and mouse giving the players the ability to print personalized and customized "Consequence" cards which the players can utilize to control the length of each game played, and with a scanner to read the bar-code printed on the "Consequence" card as each card is drawn by the players and then play each song in the order in which the "Consequence" cards are drawn while the game is being played.

DETAILED DESCRIPTION OF THE INVENTION

With further reference to the drawings, the game board of the present invention is shown therein and indicated generally by the numeral 100. Game board 100 may conform to a number of shapes and sizes. However, in the case of the embodiment illustrated in the drawings, the game board is generally rectangular and is of a flat board construction and may be foldable.

Figure 1:
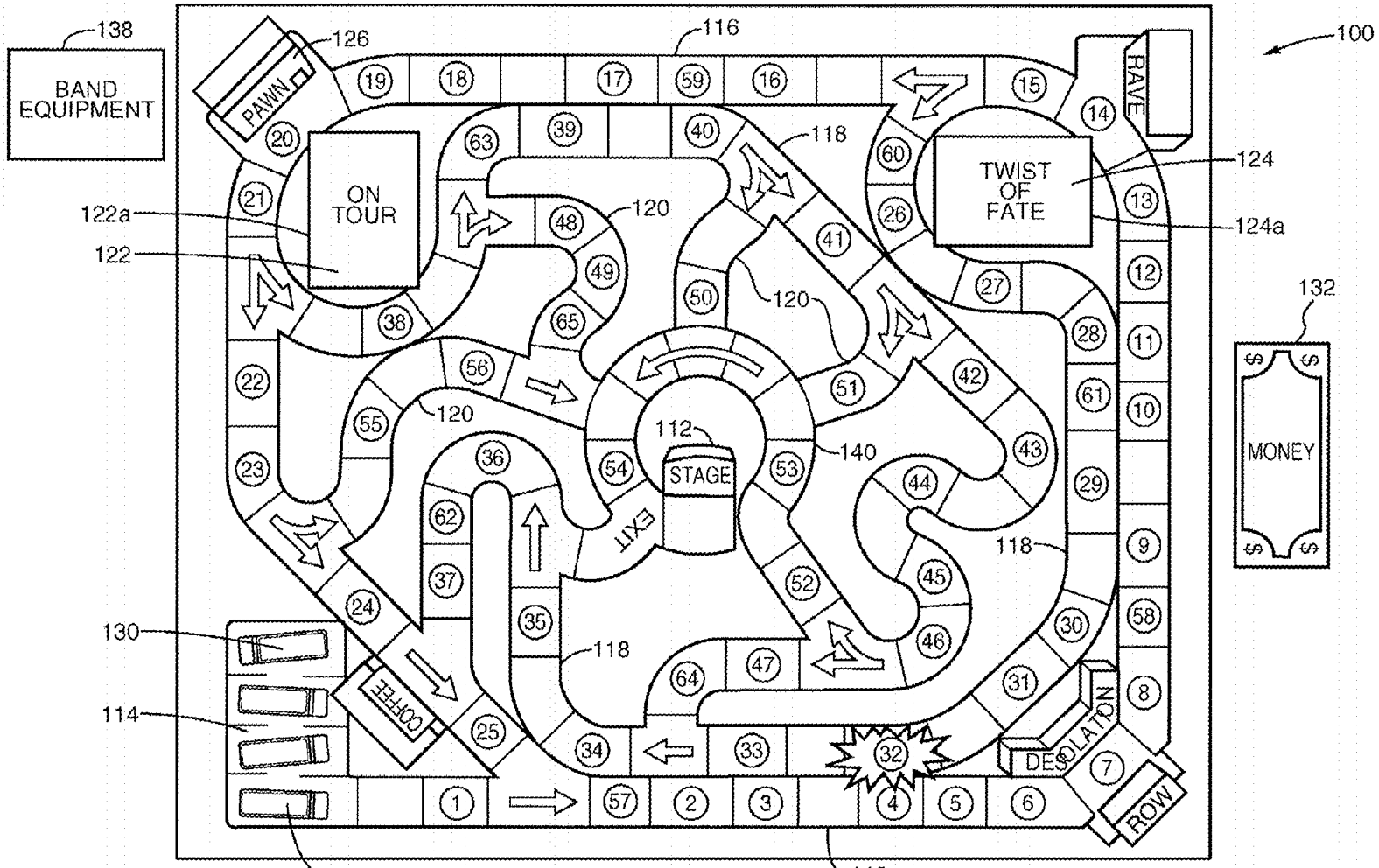
FIG. 1 is a top plan view of the game board of the present invention.

Viewing the game board in more detail, there is provided a performing stage 112 located generally in the central area of the game board. About the left hand corner of the game board viewed in FIG. 1, there is a parking lot or starting point indicated by the numeral 114. Extending from the parking lot 114 and winding around the game board 100 is a network of paths. Each of the paths is incremented. As seen in FIG. 1, the respective paths that comprise the network are curved or irregularly shaped. Some segments of the paths extend generally straight while portions or segments curve and turn. Viewing the network of paths, it is seen that the network includes one outer loop or path 116 that extends from the parking 114 across the bottom of the game board and turns upwardly and extends to the right hand corner of the game board. Thereafter the outer loop 116 extends generally horizontally across the upper portion of the game board and turns downwardly and extends along the left hand edge of the game board, again as viewed in FIG. 1, to the area of the parking lot 114 at which time the outer path turns inwardly and joins an original segment of the outer path. Connected at various points to the outer path 116 is a series of intermediate paths 118. These intermediate paths 118 again curve and turn along areas of the game board. A plurality of feeder paths 120 also forms a part of the network of paths. Feeder paths 120 generally extend inwardly from the intermediate paths 118 and join a generally circular path 140 that extends at least partially around the performing stage 112. Therefore, as will be appreciated from subsequent portions of this disclosure, tokens 130 that form a part of the game board apparatus are advanced along the various paths that make up the network of paths. As seen along the various paths, there is provided arrows that dictate the direction that the tokens are to be advanced and in numerous cases the arrows appear at points where there are options. That is, at these points the player can elect to go in one of two directions where consequence spaces are staggered at different increments in each direction where the players can utilize the paths functionally to play "Offence" or "Defense". The players are also able to utilize the design of the paths in conjunction with the other elements of the invention to stop opposing players from achieving the object of the game. In any event the players will advance their tokens 130 along the paths and as will be understood from subsequent portions of this disclosure, the object in part, at least, is to reach a performing stage 112. Therefore, in the process of moving towards the performing stage 112, the players will have to navigate at least a portion of the outer path 116. At some point along the outer path 116 the player will turn into one or more of the intermediate paths 118 or one or more of the feeder paths 120. If an intermediate path 118 is selected, then the player will eventually attempt to move from an intermediate path 118 to a feeder path 120. However, once on a feeder path 120, then the player will attempt to move to the circular path 140 in order that the player can move to the performing stage 112.

In addition to the game board that has just been generally described, the game apparatus of the present invention includes a number of card decks. In particular, there is provided a deck of "Band Member" cards 122. This deck of cards is sometimes referred to as "On Tour" cards. Further, there is a deck of cards that is referred to as "Consequence" cards 124. These "Consequence" cards 124 are sometimes referred to as "Twist of Fate" cards. Details of these cards will be discussed subsequently therein. However, at this point it should be noted that the game board 100 is adapted to receive the "Band Member" cards 122 and the "Consequence" cards 124. As viewed in FIG. 1, about the upper right hand corner of game board 100 there is provided a space 124*a* for receiving the "Consequence" or "Twist of Fate" cards 124. About the upper left hand corner of the game board as viewed in FIG. 1, there is provided a space 122*a* that is designed to receive the "Band Member" cards or "On Tour" cards 122.

Also, about the upper left hand corner, there is shown a pawn shop 126. As will be explored in more detail, the pawn shop 126 plays a significant role in the respective players obtaining band equipment, represented by a series of "Band Equipment" cards that form a part of the game.

Returning to the game board 100 it is noted that each path that forms a part of the network of paths is incremented or divided in two areas. These increments determine how far along a path a player advances after the roll of the dice 128. That is if the roll of the dice reveals a "7" then the player will advance seven increments along a path. Many of the increments formed on the respective paths include some form of indicia thereon. The indicia is generally a directive to the player and usually involves some action or consequence. However, because of the design of the layout of the pathways and strategic placement of the indicia on the pathways, the pathways themselves are utilized functionally by the players to choose to play "Offence" or "Defense". Because the design of the layout of the pathways are interrelated in a functional way with the structure of the "Band Member" cards and the "Twist of Fate" cards, the design of the game board also enables the players to utilize the pathways functionally to stop opposing players from achieving the object of the game. Furthermore, because of the before mentioned functional relationship between the various structural elements of the invention, the players are able to utilize the structure of the "Twist of Fate" deck of cards, with three different configurations, to control the length of each game played. Because of the size limitation of the drawings, the indicia could not be placed on the respective increments along the paths. Therefore, a circled number has been placed on the respective increments that are intended to have indicia. These circled numbers also appear on FIGS. 1A and 1B and adjacent each circled number is the indicia that would appear on that particular increment on the game board. For example, the circled "3" appearing in the outer path 116 about the lower portion of the game board means that that particular increment will include the indicia or phrase "Twist of Fate". A person landing on this increment would then be required to draw a card from the "Consequence" or "Twist of Fate" deck 124. Also, in the way of another example, note the circled "8" that appeared on the game board. This refers to "Band Splits Up—Discard Three Cards". The cards being referred to here are the "Band Member" cards or "On Tour" cards 122. In the way of another example, note the circled "47." As indicated on FIG. 1B, this denotes the indicia "Release New CD—Roll Collect X $2,000.00. This obviously means that the player rolls the dice and multiplies the number shown by the dice by $2,000.00 and the player collects that amount from the bank.

Figure 2:
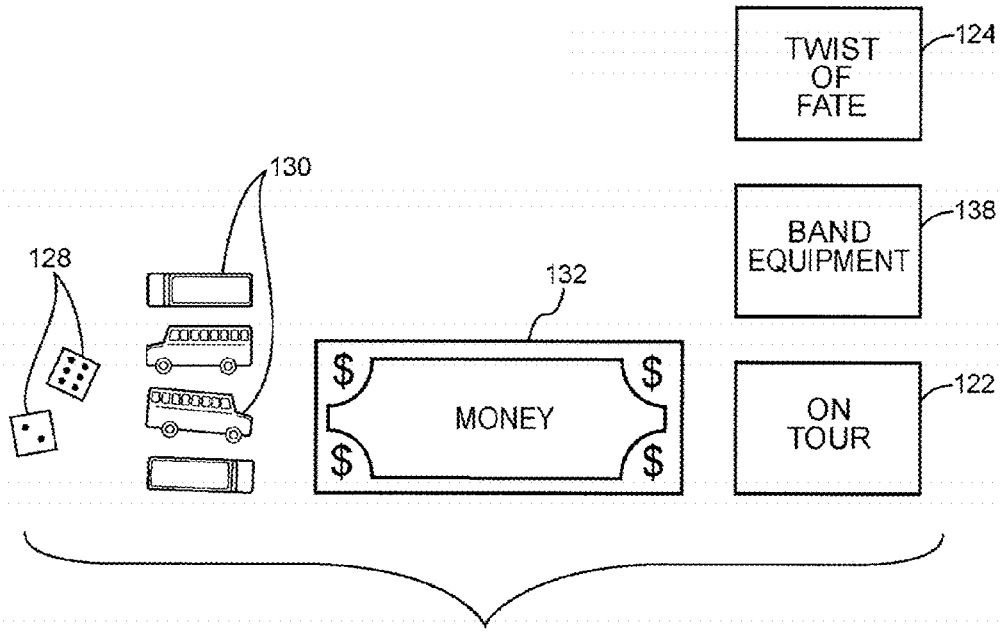
FIG. 2 is a top plan view of various components that make up the game board apparatus of the present invention.

Turning to FIG. 2, the components, other than the game board 100, of the game are shown therein. These components include a pair of dice 128, a series of tokens 130, a money supply 132, a stack of "Consequence" cards or "Twist of Fate" cards 124, a deck of "Band Member" or "On Tour" cards 122, and a set or deck of "Band Equipment" cards 138. The denominations of the money supply 132 may vary. For example, the denominations of the money supply 132 may include $100s, $500s, $1,000s, $5,000s, $10,000s, and $50,000s. Also it should be appreciate that although the series of tokens 130 are in the form of miniature buses, the nature and design of these tokens 130 may also vary.

Further, with respect to the "Consequence" or "Twist of Fate" cards 124, the number of these cards and the consequence or indicia appearing on the cards can vary. As illustrated in FIG. 3, the "Consequence" deck of cards is further divided into three configurations which are utilized by the players to control the length of each game played. Cards #1-20 represents "Configuration #1". Cards #21-40 represents "Configuration #2". Cards #11-30 represents "Configuration #3". "Rouge" cards and "Blank" cards are included, and are not part of any configuration. "Rogue" cards have an undermined effect on the length of each game played. The players are only encouraged to utilize "Rogue" cards when the players desire to change the length of each game played in an undetermined way. The "Blank" cards are utilized by the players to further personalize and customize the game. The following is an exemplary list of the indicia or consequence that appears the deck of "Consequence" or "Twist of fate" cards.

| CARD NUMBER | CONSEQUENCE OR INDICIA ON CARD |
|---|---|
| Card Number 1 | Wading in the Velvet Sea<br>Collect $1,000.00 and draw 2 cards.<br>Configuration #1 |
| Card Number 2 | Walkin'<br>Collect $1,000.00 and roll again.<br>Configuration #1 |
| Card Number 3 | Truckin'<br>Collect $2,000.00 and move 15 spaces.<br>Configuration #1 |
| Card Number 4 | With A Little Help From My Friends<br>Every player pays you $500.00<br>Configuration #1 |
| Card Number 5 | Ramble on Rose<br>Draw 2 cards and roll again.<br>Configuration #1 |
| Card Number 6 | Mr. Fantasy<br>Collect 1,000.00 and move to any space within 12 spaces forward or backwards.<br>Configuration #1 |
| Card Number 7 | Money Honey<br>Collect $5000.00<br>Configuration #1 |
| Card Number 8 | You Can't Always Get What You Want<br>Draw 2 cards and lose your next turn.<br>Configuration #1 |
| Card Number 9 | Bargain<br>Pay 1,000.00 and draw 3 cards.<br>Configuration #1 |
| Card Number 10 | Each And Every Direction<br>Every player trades 1 card with you one at a time.<br>Configuration #1 |
| Card Number 11 | Surprise Valley<br>Collect $1,000.00 and draw 3 cards.<br>Configuration #1 or #3 |
| Card Number 12 | The Magic Bus<br>Collect $2,000.00 and move to any space within 10 spaces forward or backwards.<br>Configuration #1 or #3 |
| Card Number 13 | Goodtimes Badtimes<br>Draw 3 cards and pay $2,000.00<br>Configuration #1 or #3 |
| Card Number 14 | Ain't Life Grand<br>Collect $5,000.00 and draw 5 cards.<br>Configuration #1 or #3 |
| Card Number 15 | Day Tripper<br>Collect $1,000.00 roll again and move forward or backwards.<br>Configuration #1 or #3 |
| Card Number 16 | Makes Sense to Me<br>Collect $2,000.00 and every player gives you 1 card.<br>Configuration #1 or #3 |
| Card Number 17 | If Six Was Nine<br>Collect $6,900.00 and roll again sixes count as nine.<br>Configuration #1 or #3 |
| Card Number 18 | Feeling Alright<br>Collect $500.00 and draw lcard.<br>Configuration #1 or #3 |
| Card Number 19 | Shakedown Street<br>Collect $3,000.00 and trade 2 cards with player of your choice.<br>Configuration #1 or #3 |
| Card Number 20 | Sunshine Daydream<br>Collect $5,000.00 and draw 3cards.<br>Configuration #1 or #3 |

-continued

| CARD NUMBER | CONSEQUENCE OR INDICIA ON CARD |
|---|---|
| Card Number 21 | Heart Breaker<br>Make player of your choice discard 3 cards and you discard 2 cards.<br>Configuration #2 or #3 |
| Card Number 22 | Enter Sandman<br>Make player of your choice discard all cards and you discard all your cards<br>Configuration #2 or #3 |
| Card Number 23 | Cosmik Dedris<br>Discard all your cards and blind draw 3 cards from player of your choice.<br>Configuration #2 or #3 |
| Card Number 24 | Comfortably Numb<br>Every player pays you $500.00 and you discard 3 cards.<br>Configuration #2 or #3 |
| Card Number 25 | Sabotage<br>Make player of your choice discard 3 cards.<br>Configuration #2 or #3 |
| Card Number 26 | Paint It Black<br>Every player discards 3 cards including you.<br>Configuration #2 or #3 |
| Card Number 27 | Sympathy for the Devil<br>Collect $2,000.00 and make player of your choice discard 3 cards.<br>Configuration #2 or #3 |
| Card Number 28 | Dolly Dagger<br>Make player of your choice discard 2 cards and you discard I card.<br>Configuration #2 or #3 |
| Card Number 29 | Instant Karma<br>Every player pays $1,000.00 and discards 2 cards.<br>Configuration #2 or #3 |
| Card Number 30 | Dazed and Confused<br>Pay $1,000.00 and make player of your choice discard 3 cards and you discard 1 card.<br>Configuration #2 or #3 |
| Card Number 31 | Bears Gone Fishin'<br>Blind draw one card from every player's hand.<br>Configuration #2 |
| Card Number 32 | Soul Sacrifice<br>Discard all your cards.<br>Configuration #2 |
| Card Number 33 | Piece of My Heart<br>Discard all your cards and blind draw 1 card from every player.<br>Configuration #2 |
| Card Number 34 | Weight of the World<br>Pay $5,000.00 and every player discards 2 cards.<br>Configuration #2 |
| Card Number 35 | Get Back<br>Make player of your choice discard 3 cards and you Discard 1 card and move backwards 10 spaces.<br>Configuration #2 |
| Card Number 36 | U.S. Blues<br>Pay $1,000.00 and discard 2 cards.<br>Configuration #2 |
| Card Number 37 | Fishwater<br>Blind draw 3 cards from player of your choice.<br>Configuration #2 |
| Card Number 38 | Bounce Around the Room<br>Every player discards one cards except you then move to any space within 10 spaces forward or backwards<br>Configuration #2 |
| Card Number 39 | Cry Baby Cry<br>Pay $500.00 and discard 2 cards.<br>Configuration #2 |
| Card Number 40 | Hell in a Bucket<br>Pay $1,000.00 make player of your choice discard 3 cards and you discard all your cards.<br>Configuration #2 |
| Card Number 41 | Wish You Were Here<br>Every player moves to the same space you are on no one draws a twist of fate card and you roll again.<br>ROGUE CARD |
| Card Number 42 | Across the Universe<br>Move to any space on the board.<br>ROGUE CARD |

-continued

| CARD NUMBER | CONSEQUENCE OR INDICIA ON CARD |
|---|---|
| Card Number 43 | Crosstown Traffic<br>Every player puts two cards face down at the same time<br>then trade one card left and one card right.<br>ROGUE CARD |
| Card Number 44 | Helter Skelter<br>Collect $3,000.00 discard 3cards then draw 3 cards then<br>Player to your right blind draws 2 cards from your hand<br>ROGUE CARD |
| Card Number 45 | BLANK CARD<br>(Song title input by player to personalize game)<br>(Consequence input by player to customize length of game)<br>ROGUE CARD |
| Card Number 46 | BLANK CARD<br>(Song title input by player to personalize game)<br>(Consequence input by player to customize length of game)<br>ROGUE CARD |
| Card Number 47 | BLANK CARD<br>(Song title input by player to personalize game)<br>(Consequence input by player to customize length of game)<br>ROGUE CARD |
| Card Number 48 | BLANK CARD<br>(Song title input by player to personalize game)<br>(Consequence input by player to customize length of game)<br>ROGUE CARD |

It should be appreciated that the consequences described on the "Consequence" or "Twist of Fate" cards reflect song titles from popular rock songs that are recognizable by a substantial portion of our society. These song titles are so familiar that many people will identify with them and may even relate the song titles to personal experiences. Also, as indicated above, the song titles reflect the consequences of the "Twist of Fate" cards.

The object of the game is to reach the performing stage 112 with a predetermined number of "Band Member" cards 122 of the same type. That is, as noted above, the "Band Member" cards can be color-coded into groups with each colored group representing a band. The object of the game is to arrive at the performing stage 112 with a predetermined number of "Band Member" cards of the same color. In the case of the rules for one game, the object is to arrive at the performing stage with five "Band Member" or "On Tour" cards of the same color. Further, the object is to arrive at the performance stage with one "Band Equipment" card 138. Therefore, in the course of the game, each player will move his or her token 130 around the game board, and in the process will attempt to pull together a band and finally reach the performing stage with band equipment and a sufficient number of band members. It is important to appreciate that in order to be declared a winner, a player does not have to land directly on the stage, just reach the space between the stage and the "Exit".

To begin play, each player chooses a token or bus 130 and places the token or bus in the parking lot or starting point 114. The "Band Equipment" cards 138 are placed adjacent the game board 100 and particularly adjacent the pawn shop 126. Each player receives $5,000.00 from the bank and five "Band Member" cards 122. Each player then rolls the dice 128. The lowest score begins play and play proceeds in a clockwise rotation. A player must always move forward unless a "Consequence" or "Twist of Fate" card 124 directs otherwise. A player only draws a "Consequence" card 124 when the player lands on a space designated "Consequence" card or "Twist of Fate" card. In this particular game, doubles do not roll again.

It is important to appreciate that each player must do precisely as directed by the "Consequence" or "Twist of Fate" cards 124. The only cards that are drawn, discarded or traded are the "Band Member" or "On Tour" cards 122. If a player does not have any "Band Member" cards and is directed to discard, or have opposing player blind draw from hand, or trade "Band Member" cards, then the player must pay the bank or the player designated to trade or blind draw with $500.00 per card. If the player has no money and owes money to another player, the player must borrow the money from the bank. When a player borrows money from the bank, it must be properly accounted for. These loans must be paid back to the bank. If a player owes money to the bank and possesses a "Band Equipment" card, the player must sell the "Band Equipment" card for $10,000.00. This entails discarding or giving up the "Band Equipment" card and placing it in the "Band Equipment" card deck adjacent to the pawn shop 126 and receiving $10,000.00 from the bank.

Between turns, each player must discard "Band Member" or "On Tour" cards 122 to where that player only holds no more than 7 cards. This discard procedure should take place between each turn and before drawing, trading or rolling the dice 128. If a player rolls the dice 128 while holding more than 7 "Band Member" cards or "On Tour" cards 122, then as a penalty, that player must discard all such "Band Member" cards.

To "trade" cards means that the respective players must place their cards face down and then trade them at the same time. To "blind draw" means one player is required to spread cards out and let another player draw from that player's cards.

It is important to note that a player can only purchase a "Band Equipment" card when he or she passes by or lands on the pawn shop 126. If the player passes by the pawn shop 126, then the player must pay $20,000.00 to purchase a "Band Equipment" card. If, on the other hand, the player lands on the pawn shop, then the player only has to pay $10,000.00 for the "Band Equipment" card. If, during the course of the game, a player is required to sell the "Band Equipment" card, the player must sell it for $10,000.00 irrespective of the purchase price.

In the course of the game, a player may land on a space denoted "Rave". Note for example, the space or increment denoted by the circled "14" appearing in the upper right hand corner of the game board 100. If a player lands on the "Rave" space, then the player rolls one die. If the die turns up an even number, the player draws "Band Member" cards 122. If the die turns up an odd number, then the player discard "Band Member" cards 122. Then the player rolls a second die. The number turned up on the second die is the number of cards that the player draws or discards.

The structure of the "Twist of Fate" or Consequence deck of cards as seen in FIG. 3, is designed to allow the players to control the length of each game played, when one of the three different configurations is utilized on a individual basis in conjunction with the other structural elements of the invention. Each of the three configurations of the consequence cards is designed to distinguish one of three different approximate lengths of time that the players would like the game to last. Configuration #1 distinguishes a game which will last approximately 10 to 30 minutes. Configuration #2 distinguishes a game which will last many hours, or days, having the potential to go on indefinitely. Configuration #3 distinguishes a balance between the two extremes and distinguishes a game which will last approximately 1 to 3 hours. "Rogue" cards also seen in FIG. 3, are optional cards which players can utilize to personalize and customize each game and will have an undetermined effect on the length of each game played. Players are encouraged to use "Rogue" cards, or create their own "Rogue" cards to use; only when the players are willing to affect the length of each game played in an undermined way. Configuration #1 consists of cards #1-20. Configuration #2 consists of cards #21-40 Configuration #3 consists of cards #11-30.

Configuration #1 is designed to distinguish a 10 to 30 minute game. Because all of the cards in configuration #1 award money or "Band Member" cards to the players this makes it very easy for the players to achieve the object of the game very quickly. Because configuration #1 contains no cards which enable players to break up an opposing players "band", configuration #1 will disable the apparatus which enables the players to utilize the pathways functionally in conjunction with the structure of the plurality of predetermined collectable "Band Member" cards to prevent opposing players from achieving the object of the game. Because the design of configuration #1 disables the apparatus created by the functional design and layout of the pathways and the other structural elements of the invention, the players are unable to stop opposing players from achieving the object of the game. Thus, most games played utilizing configuration #1 will last less than 15 minutes.

Configuration #2 is designed to distinguish a game which will last for many hours, or days, and has the potential to go on indefinitely. Configuration #2 creates a game that literally may never end. Because all of the cards in configuration #2 enable players to break up an opposing players "band" and/or penalize players a monetary value, this will create a game which could go on indefinitely. One must first consider the structure of the "Band Member" cards and how this structure functions. Then one must consider how this functioning structure is utilized in conjunction with the "Consequence" cards and the functional design and layout of the pathways on the game board seen in FIG. 1, in order to understand how the invention functions. The "Band Member" deck of cards, illustrated in FIG. 4, consists of a plurality of predetermined collectable "Band Member" cards. The printed matter on the "Band Member" cards divides the cards into a series of groups of cards where each series represents a "Band" and where each individual card represents a "Member" of that band. Each configuration of "Consequence" cards as seen in FIG. 3 is utilized individually in conjunction with the functioning structure of the "Band Member" deck of cards and the functional design and layout of the pathways on the game board, as seen in FIG. 4 and in FIG. 1. For example, when configuration #2 is utilized in conjunction with the "Band Member" deck of cards and the functional design and layout of the pathways, configuration #2 creates a game where the players lose "Band Member" cards at a much faster rate than the players are able to collect "Band Member" cards. Configuration #2 is also designed to take large sums of money away from the players at a fast pace. When configuration #2 is utilized in conjunction with functional designed and layout of the pathways and the functioning structure of the "Band Member" cards, configuration #2 is designed to give the players little to no chance of achieving the object of the game. The object of the game is to collect enough money to purchase a "Band Equipment" card, and then be the first player to arrive at the stage with a predetermined number of one series of "Band Member" cards and a "Band Equipment" card. The game board and indicia on the game board (with the exception of the "Consequence" spaces) is balanced to award money and "Band Member" cards at one rate, and to penalize money and "Band Member" cards at a similar but slightly slower rate, so that the "Consequence" cards control the pace of the game. When all of the "Consequence" cards penalize money and "Band Member" cards and/or enable the players to break up an opposing player's "Band", as in configuration #2, the players will lose money and "Band Member" cards at a faster rate than the money and cards can be collected. Should any player overcome the odds, when the player purchases a "Band Equipment" card and is holding multiple "Band Member" cards it would be obvious to the opposing players. At this point all of the opposing players can simply utilize the pathways functionally in conjunction with the "Consequence" cards to take away "Band Member" cards, thus breaking up the players "Band" and stopping that player from achieving the object of the game. Thus, when configuration #2 is utilized in conjunction with the other structural elements of the invention it is unlikely that any player would be able to overcome the odds to achieve the object of the game.

Configuration #3 is designed to create a balance between the two extremes of configuration #1 and configuration #2. Configuration #3 when utilized in conjunction with the other structural elements of the invention is designed to create a game which will last approximately 1 to 3 hours in length.

There are three different versions of this game. First the board game with the printer/processor equipped with a keypad, speakers, a scanner, and a port where the players connect their computers, MP3 players, or iPods as described above. The players will be able to print their own favorite song titles on the consequence cards to personalize the game. The printer will add the thrill of players being able to create their own "Rogue" consequence cards to further customize and personalize their own game. The printer will have the ability to download the player's favorite songs into the processor and assign a bar-code to each song. The printer will be equipped with speakers and a scanner. When the printer prints out the personalized "Consequence" cards with the players favorite song titles the bar-code assigned to each song title will be printed at the bottom of the card. When a player draws a "Consequence" card the bar-code will be scanned and the song will be played on the speakers.

The second version will be played on a gaming system utilizing a television and will be played with multiple controllers. Each player's controller will have a port so that each player can customize and personalize each game played. All of the same principles from above will apply to the video version. The video version will also be manufactured on a unit which is completely self-contained and will be small enough to be played on long trips in the back seat of a car or mini-van.

The third version will be an internet version, where players buy the software then log onto a website and play against other players. The opposing players could be friends, or complete strangers on the other side of the world. The same principles will apply here as above. The players will chose one of the three configurations utilized to control the length of each game played. The players will be able to create their own "Rogue" cards to personalize and customize each game played. The computer will play the song on the card each time a player draws a consequence card.

FIG. 5 schematically illustrates a game appliance that can form a part of a game apparatus for playing the game described above. The game appliance comprises a printing component, one or more keyboards, a display, a scanner, a music player, and a microprocessor, along with memory.

The printing function of the game appliance enables players to design one or more consequence cards. Depending on the particular playing mode elected by the players, the players can design a full deck of consequence cards or a part of the deck of consequence cards. In cases where players design at least some of the consequence cards, game rules may permit that the player-designed consequence cards be disclosed or not disclosed prior to the game beginning. It follows that if player-designed consequence cards are not disclosed, then the players of a game will not know what to expect, during the course of a game, with respect to consequence cards designed by other players.

In designing a certain number of consequence cards, each player uses a keyboard or other input device to input information into the game appliance. As a general rule, each card will set forth a consequence and the consequence typically will involve money, token movement, card draw (Band Member Cards), or a combination of these. Rules can be implemented to place various constraints on the nature of the consequence designed by a player. Such rules may be appropriate to limit the length of the game or to constrain the consequences in such a way that the basic spirit and concept of the game is not violated.

Consistent with the theme of the game and as described above, for each consequence card designed by a player, the player will couple a song title with the consequence. Thus, both the consequence and the song title will be provided on a respective card. Again, consistent with the theme of the game, it is anticipated that players will endeavor to logically connect the consequence with the song title or the song itself.

In one embodiment, the game appliance may include a consequence card library stored in memory in the game appliance. The consequence card library may categorize consequences according to any number of characteristics. For example, the consequence card library may break down and divide the pre-designed consequence cards into categories such as money, token movement, card draw, length of game, etc. Thus, in one embodiment, the players may elect not to design consequence cards but to select pre-design or pre-formulated consequence cards from the consequence card library.

The song titles may be automatically coupled with the consequences of the consequence cards in the library, or in the alternative, the game appliance may be provided with a library of songs or song titles stored in memory of the game appliance and players may select song titles as each consequence card is constructed. In one embodiment, the players may select and formulate consequence cards by simply selecting consequences from the consequence card library and coupling those with songs or song titles selected from a song library.

The game apparatus includes a music player, for example, a digital music player such as found in small, portable devices like MP3 players, cell phones, and other small handheld portable devices.

The game apparatus is programmed to print a code, such as a bar code, on each consequence card where the code identifies the song title on the card. During the course of a game, the code of a drawn consequence card is scanned into the game appliance and the game appliance automatically plays a selected segment of the song identified by the code on the consequence card. The game apparatus is programmable to control the length of the song segment played. That is, as noted above, during the course of a game, individual players, from time to time are required to draw a consequence card from the consequence card deck. Upon drawing a consequence card, the player is required to scan the song title code into the game appliance and the game appliance will identify the song and cause the music player component of the game appliance to play a selected segment of the song. This, of course, adds an entertaining and extra dimension to the game that is spontaneous, as well as entertaining.

The source of music played by the game appliance can vary. For example, music can be stored in the game appliance itself and played on an internal or integral music player. In addition, in one embodiment, the game appliance may include a docking station for receiving a music player such as a loaded MP3 player or an "IPod" music player. Furthermore, in some embodiments the game appliance can communicate via the internet with a digital music distributor such as the "ITunes" music source. Songs can be instantly downloaded and stored in the songs library in the game appliance.

As noted above, the game appliance includes a printer that is capable of printing on blank cards. That is, a deck of blank cards provided with the game apparatus is fed into the printer and in the process the printer prints the consequences and song titles on the blank cards being fed into and through the printer.

The above discussion focuses on the functionality of the game appliance. FIG. 5 shows in schematic form the game appliance which is indicated generally by the numeral 200. Game appliance 200 includes a microprocessor, and as indicated in FIG. 5, the microprocessor includes a microprocessor circuit 202 that is connected to a bus 204. Bus 204 is operatively connected to a program memory 206. Program memory 206 includes a game program 206A that includes program instructions that are used for designing and constructing the consequence cards described above. Further, the program memory 206 includes a configuration data module 206B.

Operatively associated with the microprocessor circuit 202 is a digital music store 208 that includes a songs database 208A and songs to be stored in the database. Further, operatively connected to the microprocessor circuit 202 via the bus 204 is a data/working memory 210. Further, there is an audio processing module 212 operatively connected to the microprocessor circuit 202. Further connected to the microprocessor circuit 202 is an audio interface 214. Operatively connected to the audio interface 214 is an output audio amp 216 that feeds one or more speakers 218 and which includes an output jack 220. In addition, operatively connected to the audio interface 214 is an input audio amp 222 that includes an auxiliary input jack 224.

As discussed above, the game appliance 200 includes a printer 226 operatively connected to the bus 204 via a printer interface 228. In the embodiment illustrated herein, there is provided a music player docking station 230 that is operatively connected to bus 204 via a music player interface 232. In addition, there is provided a scanner/reader 234 that is operatively connected to the microprocessor circuit 202 via a scanner/reader interface 236. Various types of input devices can be connected to the bus 204. In one example, there is provided one or more keyboards 238 that is connected to the microprocessor circuit 202 via a user I/O interface circuit 244. In addition, there is at least one display 240 connected to the microprocessor circuit via the user I/O interface circuit 242.

It should be appreciated that various modules can be added for controlling or monitoring various components of the game appliance. For example, the game appliance 200 may be provided with a security chip for maintaining the integrity of the music stored and played by the game appliance.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. A game apparatus comprising:

a gameboard;

the gameboard including a network of paths that lead from a starting point to a performing stage;

the network of paths including an outer path that extends around the gameboard and a plurality of feeder paths that are disposed generally between the outer path and the performing stage;

wherein, the network of paths includes a plurality of forks where at least two or more paths branch and extend from each fork;

a first deck of "consequence cards", each consequence card having a consequence associated therewith and wherein when drawing one of the consequence cards during the course of a game a player is obligated to comply with the consequence associated with the card drawn;

each path of the network of paths divided into increments and wherein the increments include increments designated consequence card increments and increments designated non-consequence increments, and wherein landing on one of the consequence card increments requires the drawing of one consequence card from the deck of consequence cards;

wherein to enable strategy and skill to be employed and to functionally relate the consequence cards to the gameboard and network of paths, the consequence increments and the non-consequence increments are spaced differently along paths leading from the respective forks formed in the network of paths;

means for varying the length of a game played on the game apparatus;

wherein the deck of consequence cards includes at least three different configurations of consequence cards and wherein the means for varying the length of a game includes employing separate configurations of the consequence cards to vary the length of the game, and wherein in a first configuration of the deck of consequence cards, the average length of the game falls within a first time period, and in a second configuration of the deck of consequence cards the average length of the game falls within a second time period, and in a third configuration of the deck of consequence cards, the average length of the game falls within a third time period, and wherein the first, second and third time periods are different;

a second deck of band member cards including a plurality of separate and distinct groups of cards with each group of band member cards designating a plurality of band members associated with a single band, such that the deck of band member cards as a whole includes an array of different band member cards representing an array of different bands;

a series of tokens provided with the game apparatus wherein a token is assigned to one player and during the course of a game, the token is advanced along one or more paths that form a part of the network of paths;

at least one die that is used to determine the number of increments on the paths that a player's token can be advanced;

a supply of money that is distributed to players;

a third deck of cards, the third deck of cards being band equipment cards with each band equipment card representing band equipment; and wherein the object of the game played with the game apparatus is for each player to advance his or her token along the network of paths and reach the performing stage with a predetermined number of one group of band member cards and a band equipment card.

2. The game apparatus of claim 1 including a printer having a programmable processor, an input device, and a memory; the printer operative to print custom consequence cards or consequence cards selected from a library of consequence cards based on information inputted near the input device.

3. The game apparatus of claim 2 including an audio player for playing songs associated with the consequence cards during the course of employing the game apparatus.

4. The game apparatus of claim 3 wherein the printer and the audio player are integrated into a single unit.

5. The game apparatus of claim 2 wherein the printer includes a docking station for receiving a portable audio player.

6. The game apparatus of claim 1 wherein the game board is provided with a threshold disposed at a point along one of the paths that make up the network of paths and wherein a player is entitled to purchase a band equipment card upon reaching the threshold.

7. The game apparatus of claim 1 wherein the structure of the band member cards and the structure of the consequence cards are interrelated in a functional way with the design and layout of the network of paths on the game board to enable players to utilize the network of paths functionally to stop opposing players from achieving the object of the game, thus affecting the length of the game.

8. The game apparatus of claim 7:

wherein in the first configuration of consequence cards, the consequence cards are so constructed that players are prohibited from utilizing the network of paths functionally to stop opposing players from achieving the object of the game, thus resulting in a game where the players are easily able to achieve the object of the game in a short period of time;

wherein in the second configuration of consequence cards, the consequence cards are constructed such that the player's ability to utilize the network of paths functionally to stop opposing players from achieving the object of the game is enhanced to the point that it is unlikely for any player to achieve the object of the game; and wherein in the third configuration, the consequence cards comprise a blend of a selected number of consequence cards from the first configuration and a selected number of consequence cards from the second configuration to strike a balance between the two extreme results rendered by the first and second configurations.

9. A method of playing a game comprising:

providing a game board having a network of paths that lead from a starting point to a performance stage where the network of paths includes an outer path that extends around the game board;

providing a plurality of feeder paths that are disposed generally between the outer path and the performance stage and forming a plurality of forks in the network of paths where at least two or more paths branch and extend from each fork;

providing a first deck of consequence cards, each consequence card having a consequence associated therewith;

providing a separate second deck of band member cards and dividing the second deck of band member cards into a plurality of separate and distinct groups of cards where each group of band member cards includes a series of cards that designate one band and where each band member card of each group designates one member of a band;

providing a separate third deck of band equipment cards where each band equipment card represents band equipment;

issuing a selected number of band member cards to players;

dividing each path of the network of paths into increments wherein the increments include increments designated consequence card increments and increments designated non-consequence card increments such that landing on one of the consequence card increments requires the drawing of one consequence card from the first deck of consequence cards;

advancing tokens across the game board and the network of paths where the tokens move across consequence card increments and non-consequence card increments and from time-to-time land on consequence card increments and non-consequence card increments;

in response to a token of one player landing on a consequence card increment, one player draws a consequence card from the first deck of consequence cards;

at selected times, discarding one or more band member cards from hands of respective players;

in response to the drawing of one or more consequence cards, at least one player drawing one or more band member cards from the hand of one or more players;

collecting band member cards and where each player collects band member cards with the object being to assemble a band by collecting a selected number of band member cards of one group;

collecting at least one band equipment card from the third deck of band equipment cards;

advancing the tokens towards the performance stage on the game board while collecting band member cards and at least one band equipment card;

declaring a winner when one player reaches the performance stage with a selected number of band member cards of one group and attempting to collect at least one band equipment card;

dividing the first deck of consequence cards into a plurality of different configurations wherein each configuration includes a different group of cards from the first deck of consequence cards and wherein each configuration results in the average time length of the game being different from any other configuration; and wherein the first deck of consequence cards is divided into three different configurations of consequence cards, and wherein in a first configuration the average length of the game falls within a first time period, in a second configuration the average length of the game falls within a second time period, and wherein in a third configuration, the average length of the game falls within a third time period, and wherein the first, second and third time periods are different.

10. The method of claim 9 wherein each player is permitted to hold a selected number of band member cards, and the method includes discarding band member cards from the hands of each player between turns such that after discarding band member cards between turns, no player holds more than the selected number of band member cards.

11. The method of claim 9 including trading one or more band member cards between players wherein the one or more cards being traded are placed face down during the course of the trade.

12. The method of claim 9 including blind drawing of band member cards from a respective player's hand wherein one player spreads the band member cards being held and another player blind draws one or more of the band member cards.

13. The method of claim 9 including printing one or more of the consequence cards with a printer associated with the game.

14. The method of claim 9 including during the course of the game, scanning an identifier on respective consequence cards that identify a song and in response to scanning the identifier, playing at least a segment of the identified song.

15. A method for playing a game comprising:

providing a game board having a network of paths that lead from a starting point to a performance stage where the network of paths include an outer path that extends around the game board;

providing a plurality of feeder paths that are disposed generally between the outer path and the performance stage and forming a plurality of forks in the network of paths where at least two or more paths branch and extend from each fork;

providing a first deck of consequence cards, each consequence card having a consequence associated therewith;

providing a separate second deck of band member cards;

dividing the second deck of band member cards into a plurality of separate and distinct groups of cards where each group of band member cards includes a series of cards that distinguish one band and wherein each band member card of each group designates one member of a band;

providing a separate third deck of band equipment cards where each band equipment card represents band equipment;

dividing each path of the network of paths into increments wherein the increments include increments designated, consequence card increments and increments designated non-consequence card increments such that landing on one of the consequence card increments requires the drawing of one consequence card from the first deck of consequence cards;

wherein the game is played by advancing tokens across the game board and along the network of paths and wherein the object of the game is for a player to reach the performance stage with a selected number of band member cards of one group and at least one band equipment card; and dividing the deck of consequence cards into at least three configurations of consequence cards such that players can vary the length of the game by selecting one of the configurations for a game, wherein in a first configuration the average length of the game falls within a first time period, in a second configuration the average length of the game falls within a second time period, and in a third configuration the average length of game falls within a third time period, and wherein the first, second and third time periods are different.

16. The method of claim 15 including interrelating in a functional way the structure of the band member cards and consequence cards with the design and layout of the network of paths of the game board so as to enable players to utilize the network of paths functionally to stop opposing players from achieving the object of the game, thereby affecting the length of the game.

17. The method of claim 15 further including:

wherein in the first configuration of consequence cards, the consequence cards are so constructed that players are prohibited from utilizing the network of paths functionally to stop opposing players from achieving the object of the game, thus resulting in a game where the players are easily able to achieve the object of the game in a short period of time;

wherein in the second configuration of consequence cards, the consequence cards are constructed such that the player's ability to utilize the network of paths functionally to stop opposing players from achieving the object of the game is enhanced to the point that it is unlikely for any player to achieve the object of the game; and wherein in the third configuration, the consequence cards comprise a blend of a selected number of consequence cards from the first configuration and a selected number of consequence cards from the second configuration to strike a balance between the two extreme results rendered by the first and second configurations.

* * * * *